US006473040B1

(12) United States Patent
Nakamura

(10) Patent No.: US 6,473,040 B1
(45) Date of Patent: Oct. 29, 2002

(54) PATCH ANTENNA ARRAY WITH ISOLATED ELEMENTS

(75) Inventor: Kiyoshige Nakamura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/664,344

(22) Filed: Sep. 18, 2000

(30) Foreign Application Priority Data

Mar. 31, 2000 (JP) ..... 2000-099495

(51) Int. Cl.[7] ..... H01Q 1/38
(52) U.S. Cl. ..... 343/700 MS; 343/841
(58) Field of Search ..... 343/700 MS, 841; H01Q 1/38

(56) References Cited

U.S. PATENT DOCUMENTS 6,069,586 A * 5/2000 Karlsson et al. ..... 343/700 MS
6,133,877 A * 10/2000 Sandstedt et al. .... 343/700 MS
6,137,444 A * 10/2000 Pettersson et al. ... 343/700 MS
6,218,989 B1 * 4/2001 Schneider et al. ... 343/700 MS
6,239,766 B1 * 5/2001 Smith et al. ..... 343/841

* cited by examiner

*Primary Examiner*—Michael C. Wimer
(74) *Attorney, Agent, or Firm*—Oblon, Spivak, McClelland, Maier & Neustadt, P.C.

(57) ABSTRACT

On the ground plate uprightly mounted in the vertical direction, a plurality of short patch antennas are provided at mutually adjacent positions, and also a pair of non-powered elements are mounted, wherein each of the non-powered elements is disposed between the plurality of short patch antenna elements in such a manner as to extend in the vertical direction and is electrically insulated from the ground plate. Due to this construction, the radiation pattern in the horizontal direction of the plurality of short patch antennas can be greatly improved.

3 Claims, 9 Drawing Sheets

PATCH ANTENNA ARRAY WITH ISOLATED ELEMENTS

BACKGROUND OF THE INVENTION

1. Field of the Invention

The present invention relates to an antenna device for use in an indoor type radio station.

2. Description of the Related Art

FIGS. 9A and 9B are illustrations showing the positional configuration of a plurality of short patch antennas mounted in a conventional antenna device, wherein FIG. 9A is a front view and FIG. 9B is a side view. FIGS. 10A and 10B are magnified views respectively of the antenna device of FIG. 9A and FIG. 9B showing one of the short patch antennas mounted therein, wherein FIG. 10A is a sectional view observed from the line cut along I—I of FIG. 9A, and FIG. 10B is a plain view of that short patch antenna. FIG. 11 is a block diagram showing a configuration of the conventional antenna device, and FIG. 12 is an illustration showing the characteristic of the radiation patterns of one of the short patch antennas (each of which may be referred to as an antenna element hereinafter) in the conventional antenna device. Further, FIG. 13 is an illustration showing the characteristic of the radiation pattern in the horizontal direction of six antenna elements closely disposed to one another in the conventional antenna device.

In these figures, reference numeral 100 denotes a rectangular ground plate, which is fixed along a wall surface within a house and supporting each of the short patch antennas whose details are explained later, numerals 101 to 106 are short patch antennas disposed on the ground plate 100 with a predetermined interval from one another, and numeral 107 denotes a covering stuff, which is 3.0 mm thick and made of a resin material such as ABS resin or the like.

In close proximity to the upper corners of the ground plate 100, a short patch antenna 101 and another short patch antenna 102, which are used for signal transmission, are disposed at a predetermined distance away from the edge surface of the ground plate 100 so as to prevent the reduction of the gains of these short patch antennas 101 and 102. On the other hand, in close proximity to the lower corners of the ground plate 100, a short patch antenna 103 and another short patch antenna 104, which are used for signal reception, are disposed at a predetermined distance away from the edge surface of the ground plate 100 or from each other so as to prevent the reduction of the gain of these short patch antennas 103 and 104, and also to eliminate the mutual effect on each other. Specially,the short patch antennas 103 and 104 provided as the signal reception antennas are disposed at a predetermined distance away from each other for eliminating the mutual effects, in order that they function together as a diversity antenna. Further, short patch antennas 106 and 105 are disposed between the short patch antennas 101 and 102 and also between the short patch antennas 103 and 104 respectively, each as an interference detection antenna for searching for a radio wave that can be an interference for communications of the base station.

Since the short patch antennas 101 to 106 have more or less the same configuration except their exact dimensions, the short patch antenna 104 is taken up here as an example for explaining the construction thereof.

The short patch antenna 104 is schematically composed of, as shown in FIGS. 10A and 10B, a radiation conductor portion 104*a* disposed in parallel to the surface of the ground plate 100 having a thickness of 1.6 mm at a predetermined interval therebetween, a ground conductor portion 104*b* in contact with the surface of the ground plate 100, and a bent portion 104c connecting these conductor portions 104*a* and 104*b*. The radiation conductor portion 104*a* is configured in such a manner as to be supplied with electric power by way of a supporting member 111 having an RF connector 110, whereas an insulation spacer 112 for maintaining the distance H between the radiation conductor portion 104*a* and the ground plate 100 is provided at the far end of the radiation conductor portion 104*a*. The ground conductor portion 104*b* is fixed to the ground plate 100 easily by a rivet 113. Note that only one side of the ground plate 100 is formed with a conductor pattern (not shown).

The length L1 of the radiation conductor portion 104*a* shown in FIG. 10B is determined in accordance with the frequency that the antenna uses, whereas the length L2 between the bent portion 104*c* and the power feeding point P is set in such a manner that the impedance becomes 50 ohm. The width W of the ground conductor portion 104*b* is determined by the gain of the antenna.

As shown in FIG. 11, the short patch antennas (TX1) 101 and (TX2) 102 are transmission antennas, which are connected respectively to a first transmitter 120 and a second transmitter 121. The short patch antenna (RX1) 103 is connected in a branched manner to a first receiver 123 and also to a third receiver 124 by way of an amplifier (AMP) 122, the short patch antenna (RX2) 104 is connected in a branched manner to a second receiver 126 and also to a fourth receiver 127 by way of an amplifier (AMP) 125. The short patch antenna (MX1) 105 is connected in a branched manner to the first receiver 123 and the second receiver 126 by way of an element 128 provided with the function of an amplifier and that of a frequency converter, and these first receiver 123 and second receiver 126 are connected to a first signal combiner 129. Further, the short patch antenna (MX2) 106 is connected in a branched manner to the third receiver 124 and the fourth receiver 127 by way of an element 130 provided with the function of an amplifier and that of a frequency converter, and these third receiver 124 and fourth receiver 127 are connected to a second signal combiner 131.

In the antenna device configured as mentioned above, the first transmitter 120 and the second transmitter 121 use different frequencies from each other, which are different also from those of the receivers 123, 124, 126 and 127.

The operation of the conventional antenna device is as follows.

First of all, when a signal transmitted from the nearby area of the radio station is received by the short patch antenna 105 that is an interference detection antenna, the thus received signal is amplified at the element 128 where a frequency conversion is processed, and thereafter sent to the first receiver 123 and the second receiver 126, wherein if the frequency of the thus received signal is same as that of the signals transmitted from the first transmitter 120 and the second transmitter 121, then the transmission of signals of the corresponding frequency is prohibited in order to prevent a possible interference.

After the above procedure by use of the interference detection antenna, a signal transmission at a usable frequency is started. In this case, a TDMA (Time Division Multiple Access) communication is enabled by dividing one cycle of a transmitted signal into three portions, and also by allocating one frequency to three communication lines. In this antenna device, two transmitters 120 and 121 are used, wherein if the both frequencies are usable; each transmitter can hold three communication lines, so that communications of 6 lines can be assured in parallel by the whole antenna device. The communication using this time-division method can be applied even in the signal receiving case.

Next, in the case of signal receiving, the same one signal is received simultaneously by two different antennas; namely the short patch antennas 103 and 104, and thereafter the thus received signals are amplified by the amplifier 122 and 125, respectively, and the amplified signals are then fed through the first receiver 123 and the second receiver 126 to a first signal combiner 129 where these signals are combined after synchronizing the phase of each signal. This can be done by use of the diversity technique for improving the strength of signal reception.

It is to be noted here that the radiation patterns made of one short patch antenna in the horizontal direction are made in such a manner, as shown in FIG. 12, that the level of the peak gain G1 of the radiation pattern of the main polarized wave, which is the gain obtained by directing the longitudinal direction of an antenna (hereinafter referred to just as the antenna direction) to the electric field, is almost same as that of the peak gain G2 of the radiation pattern of the cross-polarized wave, which is the gain obtained by directing the antenna to the direction intersecting the electric field at right angles. Contrary to this, in the case where a plurality of short patch antennas are closely disposed in a limited narrow area on the ground plate, the radiation patterns of one of those short patch antennas are made in such a manner that the level of the peak gain G2 of the cross-polarized wave is lower than that of the peak gain G1 of the main polarized wave by the effect of other short patch antennas which are disposed at a distance shorter than the length of 1 wavelength as shown in FIG. 13.

In this situation above, since in the case of an antenna device provided in an outdoor-type radio station, only the main polarized wave is generally used, so that no serious problem would occur even when the gain of the cross-polarized wave is lowered, whereas since in an antenna device provided in an indoor-type radio station, the transmitted/received waves crash against wall surfaces inside a house and subsequently the polarized surface is thus rotated, so that not only the main polarized wave but the cross-polarized wave can also be used for carrying out communications. For this reason, when the gain of the cross-polarized wave is lowered, the radiation pattern in the horizontal direction is deteriorated, degrading thereby the communication quality as a whole.

The present invention has been proposed to solve the problems aforementioned, and it is an object of the present invention to provide an antenna device which is capable of improving the radiation pattern in the horizontal direction of a plurality of short patch antennas which are closely mounted to each other.

SUMMARY OF THE INVENTION

In order to achieve the above object, an antenna device according to a first aspect of the present invention is constructed in such a manner that it comprises: a ground plate uprightly mounted in the vertical direction, a plurality of short patch antenna elements disposed on the ground plate adjacent to each other, and a pair of non-powered elements, each of which is disposed between the short patch antenna elements in such a manner as to extend in the vertical direction.

An antenna device constructed as above further comprises metal fixing elements for fixing the non-powered elements to the ground plate, which metal fixing elements protruding from the non-powered elements in the direction intersecting the direction of the electric field at right angles.

An antenna device according to further aspect of the present invention is constructed such that each of the non-powered elements are formed with a spacer at the respective end portions thereof for suppressing vibrations possibly transmitted from said ground plate, wherein the spacer is made of an electrically insulative material.

An antenna device according to further aspect of the present invention is constructed such that the metal fixing elements and the ground plate are electrically insulated from each other.

An antenna device according to still further aspect of the present invention is constructed such that the insulation in the above configuration is performed by slits formed in the surface of the ground plate around said respective metal fixing elements.

BRIEF DESCRIPTION OF THE DRAWINGS

FIGS. 1A and 1B are illustrations showing an antenna device according to a first embodiment of the present invention, wherein FIG. 1A is a plain view and FIG. 1B is a side view thereof.

FIGS. 3A and 3B are illustrations showing an antenna device according to a second embodiment of the present invention, wherein FIG. 3A is a plan view and FIG. 3B is a side view thereof.

FIGS. 9A and 9B are illustrations showing the positional structure of the short patch antennas in a conventional antenna device, wherein FIG. 9A is a plan view and FIG. 9B is a side view thereof.

FIGS. 10A and 10B are illustrations showing the magnified view of the short patch antenna mounted in the antenna device shown in FIGS. 9A and 9B, wherein FIG. 10A is a sectional view observed from the line cut along I—I of FIG. 9, and FIG. 10B is a plain view of that short patch antenna.

DETAILED DESCRIPTION OF THE PREFFERED EMBODIMENTS

Several embodiments of the present invention are now explained with reference to the accompanying drawings.

First Embodiment

Figure 1A:
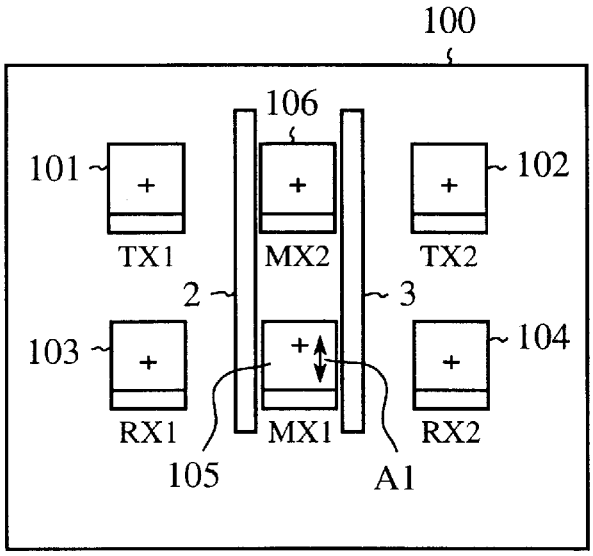
Figure 1B:
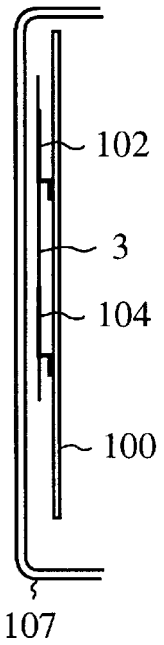
Figure 2:
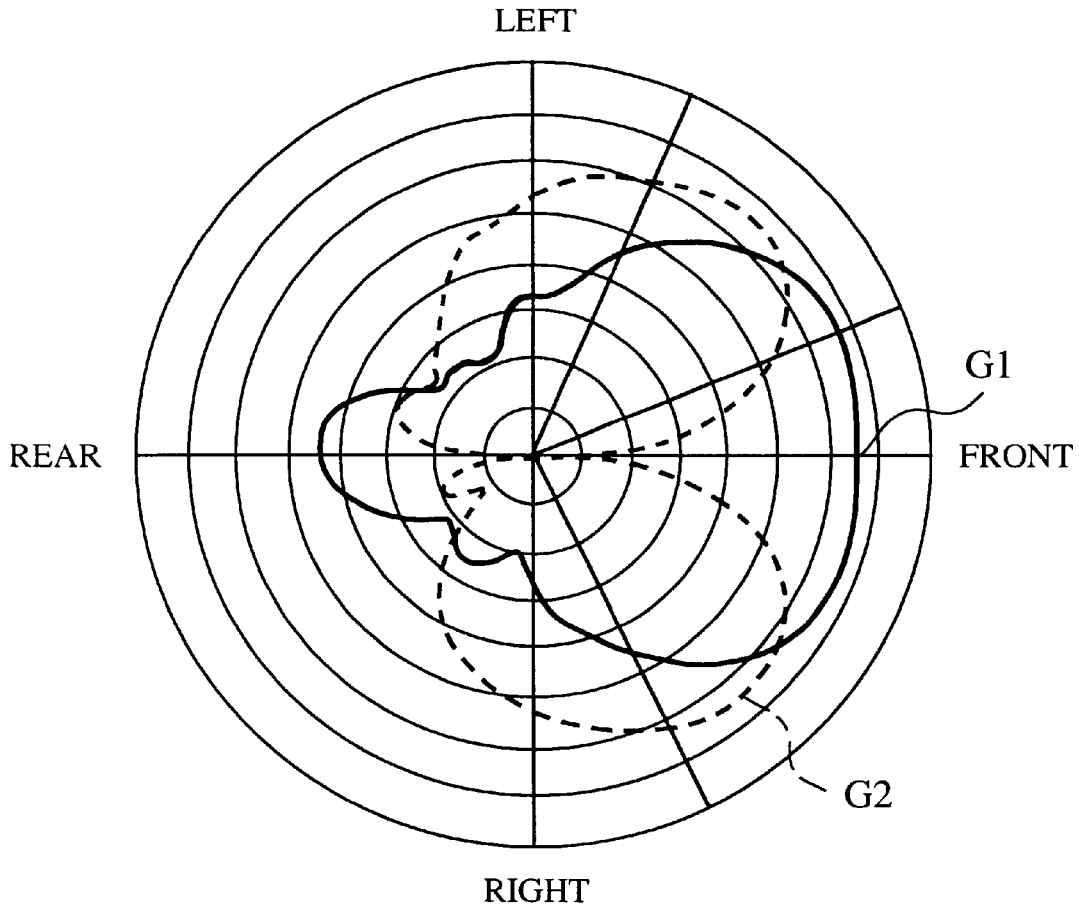
FIG. 2 is an illustration showing the characteristic of the radiation pattern in the horizontal direction of each of the short patch antennas in the antenna device of FIGS. 1A and 1B.

FIGS. 1A and 1B are illustrations showing an antenna device according to a first embodiment of the present invention, wherein FIG. 1A is a plain view and FIG. 1B is a side view thereof. FIG. 2 is an illustration showing the characteristic of the radiation pattern in the horizontal direction of each of the antenna elements in the antenna device shown in FIGS. 1A and 1B. Note that the word "antenna element" may be hereinafter referred to as a short patch antenna element or a short patch antenna as mentioned before, or even as a powered antenna or a powered antenna element. Within the structural elements configuring the antenna device of this first embodiment, the same reference numerals are put to the elements same or similar to those configuring the conventional antenna device, and the explanation thereabout is thus omitted here.

In these figures, reference numeral 2 denotes an element to which no power is fed (hereinafter referred to just as a non-powered element), and is disposed between the short patch antenna 101 as a transmission antenna and the short patch antenna 106 as an interference detection antenna disposed adjacent to the short patch antenna 101 on the surface of the ground plate 100, and is also disposed between the short patch antenna 103 as a reception antenna and the short patch antenna 105 as an interference detection antenna disposed adjacent to the short patch antenna 103 on the surface of the ground plate 100. Similarly, reference numeral 3 denotes a non-powered element, which is disposed between the short patch antenna 102 as a transmission antenna and the short patch antenna 106 as an interference detection antenna disposed adjacent to the short patch antenna 102 on the surface of the ground plate 100, and is also disposed between the short patch antenna 104 as a reception antenna and the short patch antenna 105 as an interference detection antenna disposed adjacent to the short patch antenna 104 on the surface of the ground plate 100, these non-powered elements can be referred to as a "dipole element" as well. These non-powered elements 2 and 3 are metal-made elongate plates, each having the length of 1 wavelength, and is fixed by way of a spacer (not shown) made of an electrically insulative material such as styrene foam or the like mounted on the ground plate 100 that is provided upright in the vertical direction. For this reason, these non-powered elements 2 and 3 are provided extendedly along the surface of the ground plate 100 in the vertical direction. In this configuration, if the ground plate 100 and these non-powered elements 2 and 3 are electrically connected, the effect of improving the deterioration of the radiation pattern made by these non-powered elements 2 and 3 is greatly reduced, as the distribution of the electrical field induced by these non-powered elements is limited to the region in which electric potential at their connected portion to the ground plate is zero. For this reason, in order to eliminate this problem, the non-powered elements 2 and 3 are insulated so as not to be electrically conducted to the ground plate 100.

The operation of the antenna device according to the first embodiment of the present invention is now explained as follows.

Figure 12:
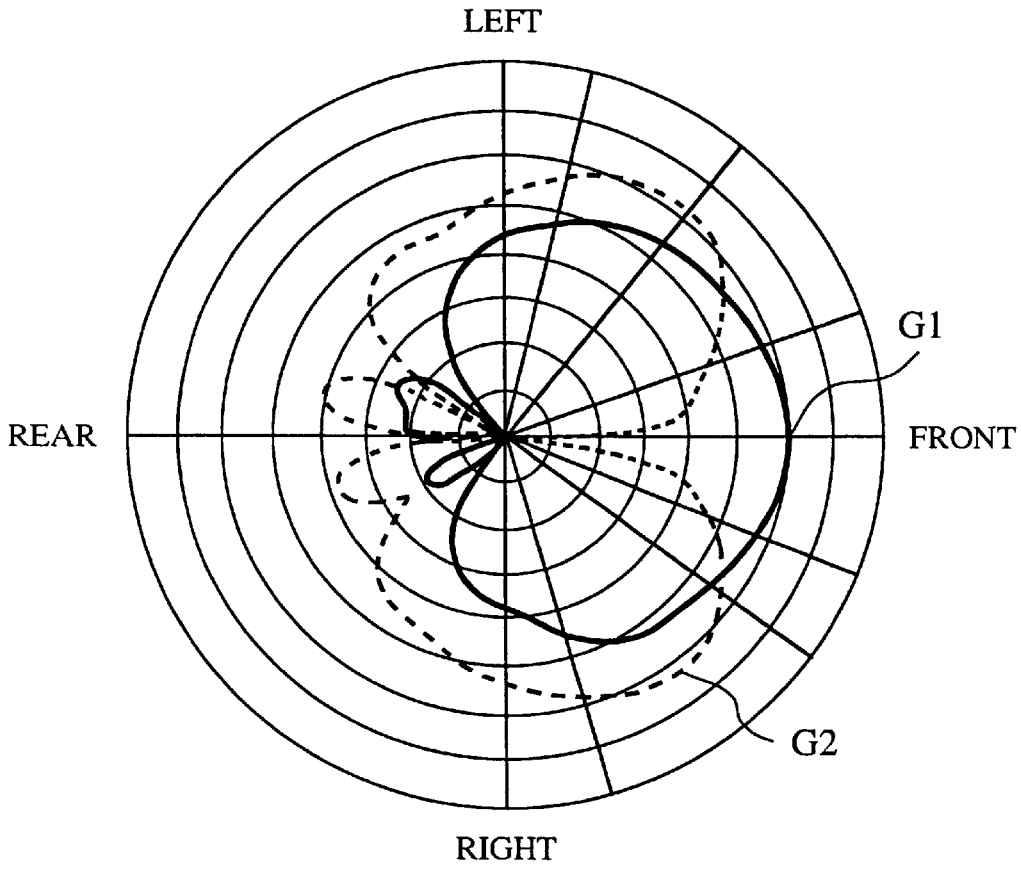
FIG.12 (PRIOR ART)
FIG. 12 is an illustration showing the characteristic of the radiation patterns in the horizontal direction of one of the short patch antennas in the conventional antenna device.
Figure 13:
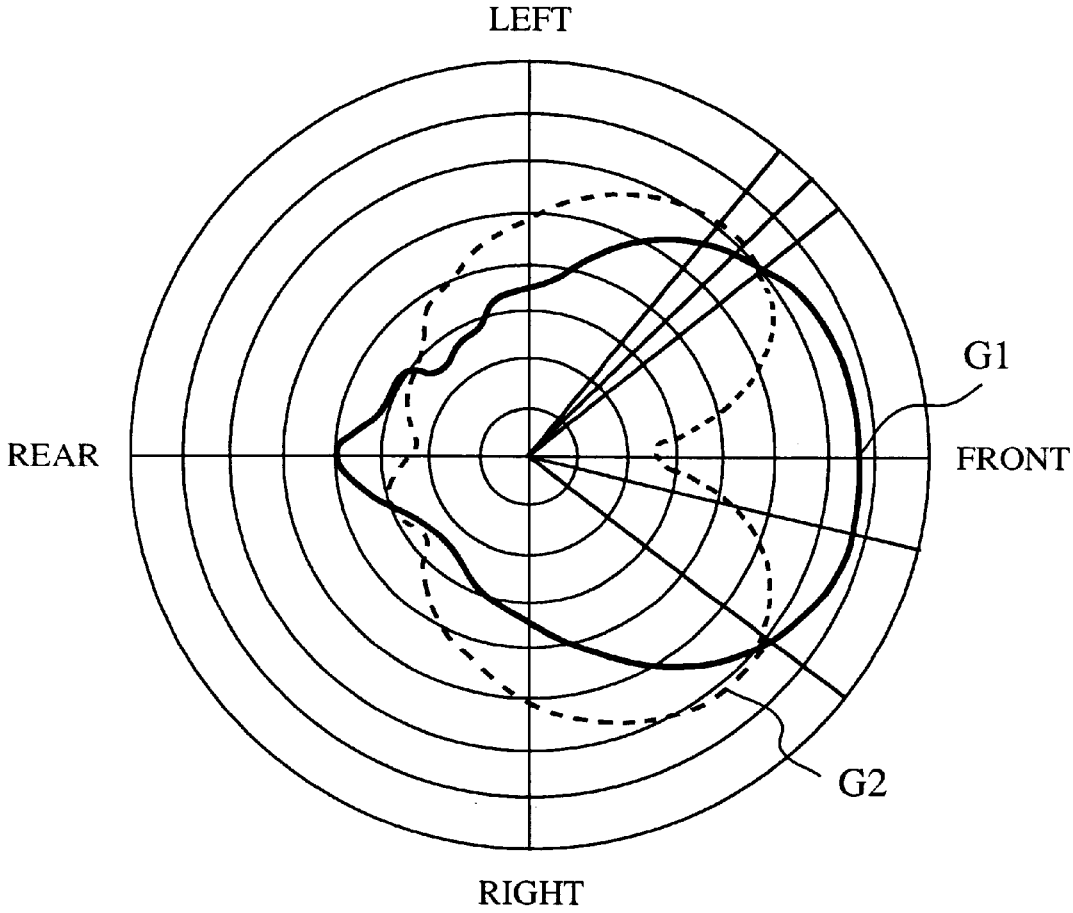
FIG.13 (PRIOR ART)
FIG. 13 is an illustration showing the characteristic of the radiation patterns in the horizontal direction of six short patch antenna elements in the conventional antenna device.

The radiation patterns of each of the six short patch antennas 101 to 106 in the horizontal direction are set such that the peak gain G1 of the radiation pattern of the main polarized wave and the peak gain G2 of the radiation pattern of the cross-polarized wave are in the almost same level with each other, so that they are by no means inferior to the radiation patterns (FIG. 12) in the horizontal direction of the case where only one of these short patch antennas 101 to 106 is disposed, and this means the fact that the deterioration of the radiation pattern in the horizontal direction of each of the short patch antennas 101 to 106 can be prevented by the non-powered elements 2 and 3. Further, as for the radiation patterns shown in FIG. 2, they are superior to the case of FIG. 12, as the directive gain thereof becomes wider in the forward direction, so that signals can be obtained in a wide range.

As explained above, according to this first embodiment, even when a plurality of short patch antennas are disposed on a small-sized ground plate adjacent to each other, the deterioration of the radiation patterns in the horizontal direction of each of the short patch antennas can be prevented, and the characteristic of the radiation pattern of an independently mounted short patch antenna can be maintained, so that an antenna device provided with such short patch antennas can be made smaller.

It is to be noted that in the first embodiment, by setting one of the non-powered elements; namely the non-powered element 2 for example, in such a manner as to be commonly used by a plurality of antennas 105 and 106, disposition of individual non-powered elements for each of these short patch antennas 105 and 106 is no longer needed, facilitating thereby the mounting operation thereof.

Second Embodiment

Figure 3A:
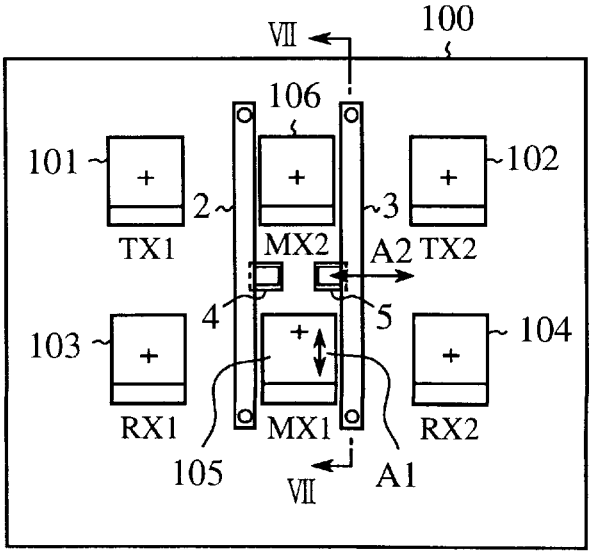
Figure 3B:
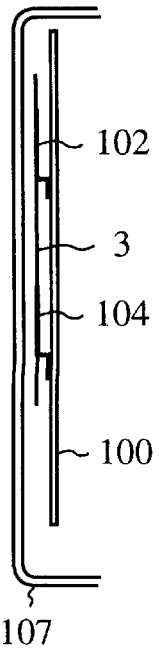
Figure 4:
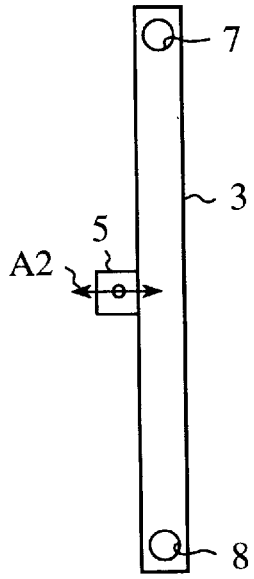
FIG. 4 is a plain view showing the magnified non-powered element shown in FIG. 3A.
Figure 5:
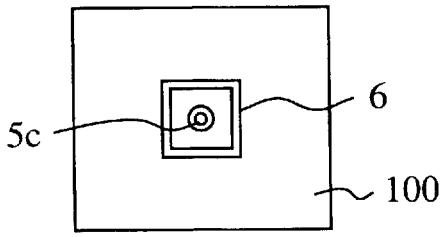
FIG. 5 is a plain view showing the magnified metal fixing portion shown in FIG. 4
Figure 6:
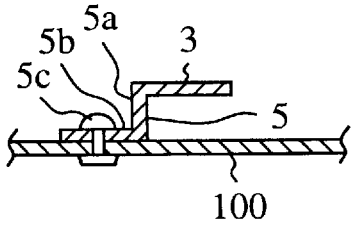
FIG. 6 is a sectional view showing the configuration of the metal fixing portion shown in FIG. 4 when it is mounted on the ground plate.
Figure 7:
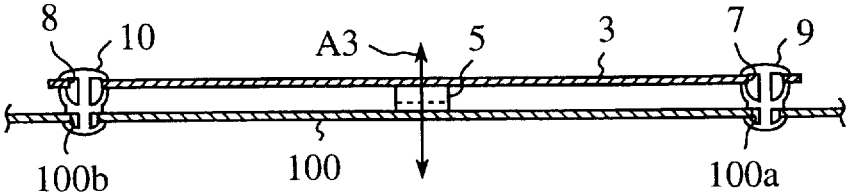
FIG. 7 is a sectional view observed from the line cut along VII—VII of FIG. 3A.
Figure 8:
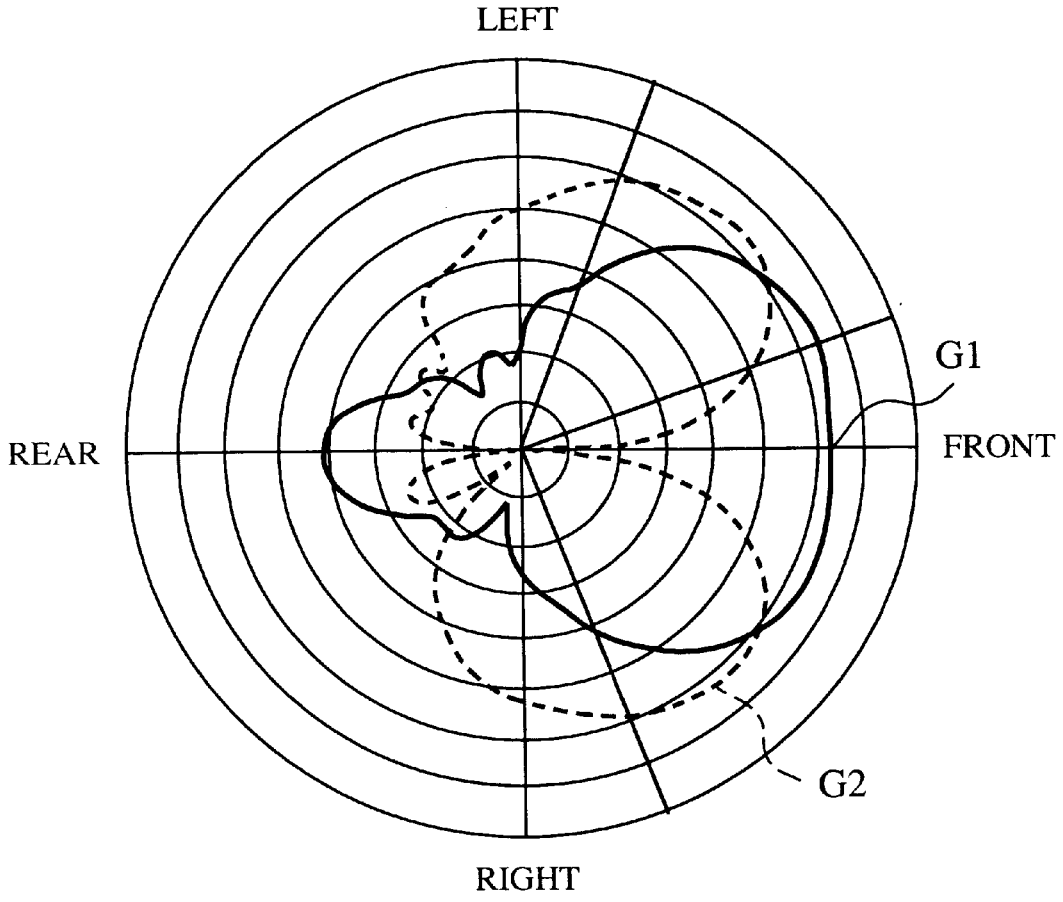
FIG. 8 is an illustration showing the characteristic of the radiation patterns in the horizontal direction of each of the short patch antennas in the antenna device of FIGS. 3A and 3B.
Figure 9A:
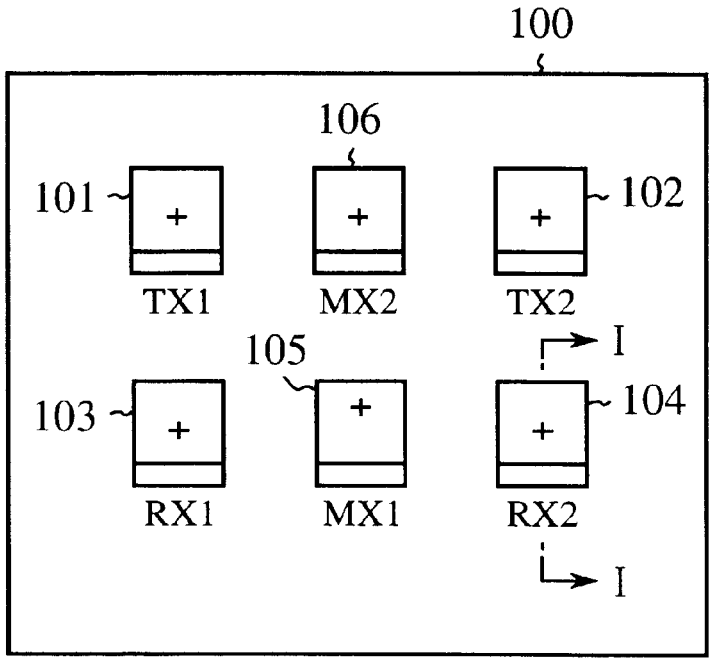
FIG.9A (PRIOR ART)
Figure 9B:
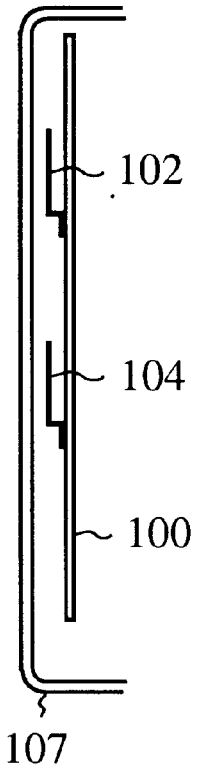
FIG.9B (PRIOR ART)
Figure 10A:
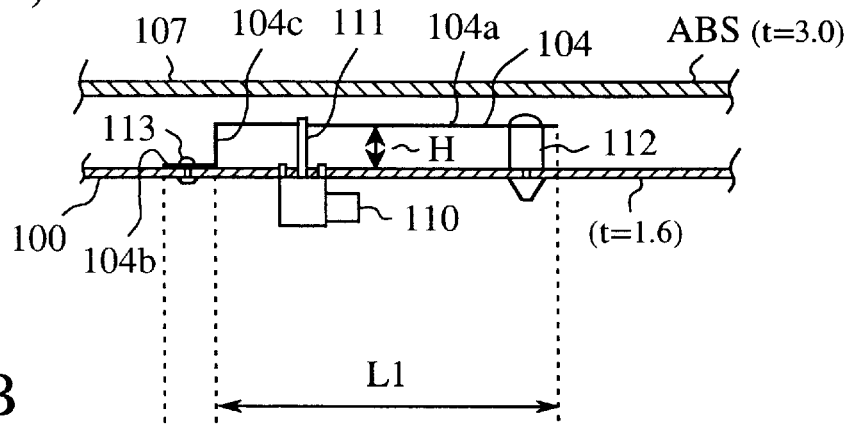
FIG.10A (PRIOR ART)
Figure 10B:
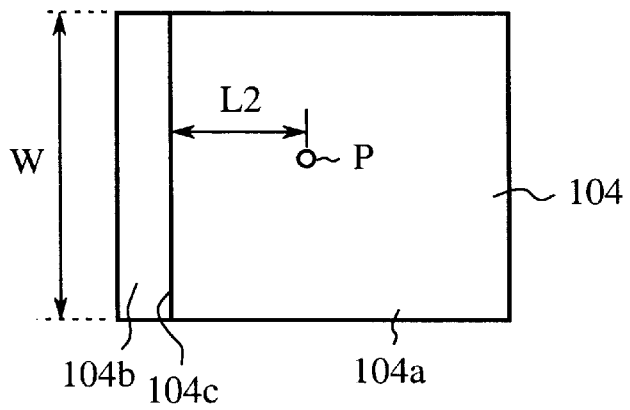
FIG.10B (PRIOR ART)
Figure 11:
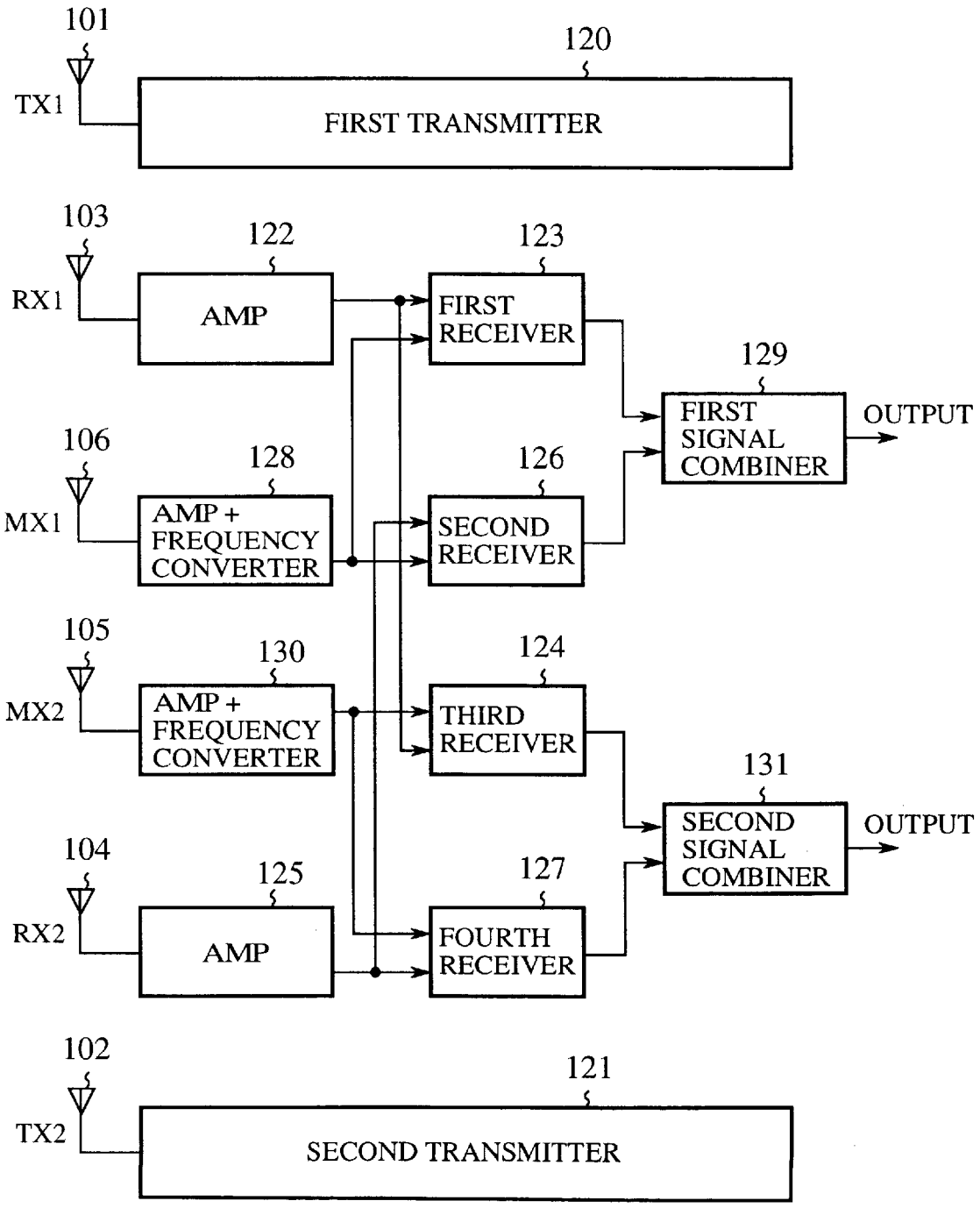
FIG.11 (PRIOR ART)
FIG. 11 is a schematic diagram showing a construction of the conventional antenna device.

FIGS. 3A and 3B are illustrations showing an antenna device according to a second embodiment of the present invention, wherein FIG. 3A is a plan view and FIG. 3B is a side view thereof. FIG. 4 is a plain view showing the magnified non-powered element shown in FIG. 3A. FIG. 5 is a plain view showing the magnified metal fixing portion shown in FIG. 4. FIG. 6 is a sectional view showing the configuration of the metal fixing portion shown in FIG. 4 when mounted on the ground plate 100. FIG. 7 is a sectional view observed from the line cut along VII—VII of FIG. 3A, and FIG. 8 is an illustration showing the characteristic of the radiation patterns in the horizontal direction of each of the short patch antennas in the antenna device of FIGS. 3A and 3B. Within the elements configuring the antenna device of this second embodiment, the same reference numerals are put to the elements same or similar to those configuring the conventional antenna device of the first embodiment, and the explanation thereabout is thereby omitted here.

In this embodiment, in fixing the center portion of each of the non-powered elements 2 and 3 of the first embodiment to the ground plate 100 respectively by way of metal fixing elements 4 and 5, the metal fixing elements 4 and 5 are set in such a manner as to protrude from the corresponding non-powered elements 2 and 3 in the direction (for instance, direction indicated by an arrow A2 in FIG. 3A) which is intersecting the direction of the electric field at right angles (direction indicated by an arrow A1 in FIG. 3A) induced by these non-powered elements 2 and 3, which is the technical feature of this embodiment.

In other words, if the metal fixing elements 4 and 5 are directly mounted to one part of the non-powered elements 2 and 3, the non-powered elements 2 and 3 respectively having the length of 1 wavelength are divided into two parts, and the electric field is destroyed, resulting in the reduction of the deterioration preventing characteristic of these non-powered elements 2 and 3 with respect to the powered antenna elements. For this reason, by setting the metal fixing elements 4 and 5 in such a manner as to protrude in the direction intersecting the direction of the electric field at right angles (for instance, direction indicated by an arrow A2 in FIG. 3A), an adverse effect possibly caused by the metal fixing elements 4 and 5 on the deterioration preventing characteristic of the non-powered elements 2 and 3 can be eliminated.

The metal fixing elements 4 and 5 are symmetrical to each other, and their configurations are basically the same. For example, the metal fixing element 5 is schematically composed of, as shown in FIG. 6, a vertical arm portion 5*a* extending in the direction indicated by an arrow A3 from the center portion of the side periphery of the non-powered element 3, a grounding portion 5*b* which extends from the lowermost end of this vertical arm portion 5*a* and is grounded to the ground plate 100, and also a rivet 5*c* for fixing this grounding portion 5*b* to the ground plate 100.

Although the grounding portion 5*b* of the metal fixing element 5 is grounded to the ground plate 100 as explained above, there is formed an insulation slit 6 around this grounding portion as shown in FIG. 5, by notching the conductor pattern for example made of a copper film or the like formed in the ground plate. Because of this slit 6, the non-powered element 3 can be electrically insulated from the ground plate 100, so that an adverse effect possibly caused by the metal fixing element 5 on the deterioration of improvement in the radiation pattern of the non-powered element 3 can be eliminated. Regarding this fact as well, the non-powered element 2 has a same configuration as that of the non-powered element 3.

Further, the non-powered element 3 is formed with mounting grooves 7 and 8 at the opposite ends thereof, and on the ground plate 100, mounting grooves 10*a* and 100*b* are formed at the same position opposing to the above-explained groves 7 and 8. These mounting grooves 7 and 8 of the non-powered element 3 side are linked to the mounting grooves 100*a* and 100*b* of the ground plate 100 side by an anti-vibration spacers 9 and 10. The non-powered element 3 is supported by the metal fixing element 5 in the center portion thereof, wherein if a vibration is transmitted to the ground plate 100, the non-powered element 3 is also vibrated, so that the structure of the non-powered element 3 can possibly be destroyed. In order to prevent this phenomenon, in this second embodiment the above-explained anti-vibration spacers 9 and 10 are provided for suppressing vibration of the non-powered element 3. Note that the material for these spacers 9 and 10 can be any material as long as it is an electrically insulative material.

Regarding this fact as well, the non-powered element 2 has the same configuration as that of the non-powered element 3.

The operation of the antenna device according to the second embodiment of the present invention is now explained as follows.

The radiation patterns of each of the six short patch antennas 101 to 106 in the horizontal direction are set such that the peak gain G1 of the radiation pattern of the main polarized wave and the peak gain G2 of the radiation pattern of the cross-polarized wave are in the almost same level to each other, so that they are by no means inferior to the radiation pattern (FIG. 12) in the horizontal direction of the case where only one of these short patch antennas 101 to 106 is disposed independently, and this means the fact that even if the metal fixing elements 4 and 5 are provided to the non-powered elements 2 and 3, these metal fixing elements 4 and 5 do not affect on the radiation patterns in the horizontal direction of each of the short patch antennas 101 to 106, and thus the deterioration of the radiation patterns in the horizontal direction of each of the short patch antennas 101 to 106 can be prevented by the non-powered elements 2 and 3, just as the case of the first embodiment.

As explained above, according to this second embodiment, since the metal fixing elements 4 and 5 are arranged in such a manner as to protrude in the direction intersecting the direction of the electric field from the non-powered elements 2 and 3 at right angles, an adverse effect possibly caused by the metal fixing elements 4 and 5 on the deterioration preventing characteristic of the non-powered elements with respect to the short patch antennas can be prevented.

As explained heretofore, according to the present invention, since the non-powered elements extending along the vertical direction are provided between the short patch antenna elements, when these antennas are disposed adjacent to each other at a distance shorter than the length of 1 wavelength, the deterioration of the radiation patterns in the horizontal direction possibly caused by the effect of other short patch antenna elements disposed therearound can be improved. Subsequently, even if these antennas are disposed adjacent to each other, the radiation pattern thereof in the horizontal direction is not deteriorated, and thus the characteristic of an independently mounted short patch antenna can be maintained, so that an antenna device provided with such short patch antennas can be made small as a whole.

According to the present invention, since the metal fixing portions for fixing the non-powered elements to the ground plate are further included, and these metal fixing portions are set in such a manner as to protrude from the non-powered elements in the direction intersecting at right angles with the direction of the electric field induced by the non-powered elements, an adverse effect on the deterioration preventing characteristic of the non-powered elements with respect to the short patch antennas by these metal fixing elements 4 and 5 can be eliminated.

According to the present invention, since the metal fixing portions are insulated from the ground plate, the limitation to the distribution of electric field induced by the non-powered elements can be eliminated, so that the deterioration preventing characteristic of the radiation patterns of the antenna elements by the non-powered elements can be used at maximum efficiency.

What is claimed is:

1. An antenna device comprising:

a ground plate uprightly mounted in the vertical direction;

a plurality of patch antenna elements disposed on the ground plate adjacent to each other;

non-powered elements that are electrically insulated from said ground plate; and metal fixing elements for fixing said non-powered elements to said ground plate, said metal fixing elements protruding from said non-powered elements in the direction intersecting the direction of the electric field at right angles, wherein each of said non-powered elements is configured to separate horizontally adjacent patch antenna elements and to extend in the vertical direction and each of said non-powered elements are formed with a spacer at the respective end portions thereof for suppressing vibrations transmitted from said ground plate, said spacer being made of an electrically insulative material.

2. An antenna device comprising:

a ground plate uprightly mounted in the vertical direction;

a plurality of patch antenna elements disposed on the ground plate adjacent to each other;

non-powered elements that are electrically insulated from said ground plate; and metal fixing elements for fixing said non-powered elements to said ground plate, said metal fixing elements protruding from said non-powered elements in the direction intersecting the direction of the electric field at right angles, wherein each of said non-powered elements is configured to separate horizontally adjacent patch antenna elements and to extend in the vertical direction and said metal fixing elements and the ground plate are electrically insulated from each other.

3. An antenna device according to claim 2, wherein insulation is provided by slits formed in the surface of the ground plate around said metal fixing elements.

* * * * *